United States Patent [19]

Smith

[11] Patent Number: 5,048,543

[45] Date of Patent: Sep. 17, 1991

[54] CONTINUOUS ROD-MAKING MACHINES

[75] Inventor: Michael N. Smith, High Wycombe, England

[73] Assignee: Molins Richmond Inc., Richmond, Va.

[21] Appl. No.: 431,207

[22] Filed: Nov. 3, 1989

[30] Foreign Application Priority Data

Nov. 4, 1988 [GB] United Kingdom ..... 8825863

[51] Int. Cl.[5] ..... A24C 5/18

[52] U.S. Cl. ..... 131/84.4; 131/84.1

[58] Field of Search ..... 131/84.1, 84.4; 493/65; 83/310, 327-328

[56] References Cited

U.S. PATENT DOCUMENTS

| | | | |
|---|---|---|---|
| 4,160,575 | 7/1979 | Schraut . | |
| 4,230,391 | 10/1980 | Keglewitsch . | |
| 4,244,250 | 1/1981 | Rudszinat | 83/310 |
| 4,248,113 | 2/1981 | Verjux | 83/310 |
| 4,478,231 | 10/1984 | Rudszinat | 131/84.4 |
| 4,539,998 | 9/1985 | McCord et al. . | |
| 4,576,181 | 3/1986 | Wallace et al. . | |
| 4,589,287 | 5/1986 | Dickens . | |
| 4,679,567 | 7/1987 | Hanlon et al. . | |
| 4,686,764 | 8/1987 | Adams et al. . | |

FOREIGN PATENT DOCUMENTS

| | | |
|---|---|---|
| WO8602446 | 4/1986 | PCT Int'l Appl. . |
| 1089025 | 11/1967 | United Kingdom . |
| 1471258 | 4/1977 | United Kingdom . |

OTHER PUBLICATIONS

FIG. I-2 from Cobe Laboratories sales training slide.
Shin-Etsu Polymer product brochure.
Metl-Plas Process brochure.

*Primary Examiner*—Vincent Millin
*Assistant Examiner*—Lynne Reichard
*Attorney, Agent, or Firm*—Antonelli, Terry, Stout & Kraus

[57] ABSTRACT

A rotary ledger for a continuous rod-making machine includes gears (50,54) having interengaging teeth which are subjected to a pressure applied by resilient means to reduce or eliminate backlash. The pressure is applied as a predetermined torque applied through coaxial gear portions (50A, 50B, 54A, 54B) which are effectively urged to rotate in opposite direction swhile remaining engaged with a common further gear (46). A rotary torque limiting device (74) is connected to one end of a flat torsion spring (68) the other end of which is connected to one of the coaxial gear portions (50A) for applying the torque. An oil flow arrangement (124-132) is provided for ensuring adequate lubrication of at least one bearing (120) for a shaft (42) extending through the ledger housing (38) while preventing escape of oil with possible consequent contamination of the rod. The arrangement includes an oil supply path passing through the bearing in a direction from the interior of the housing, an oil receiving chamber within the housing, and a collector tube which collects oil by action of centrifical force as the housing rotates and returns it to the interior of the housing.

23 Claims, 4 Drawing Sheets

CONTINUOUS ROD-MAKING MACHINES

Figure 1:
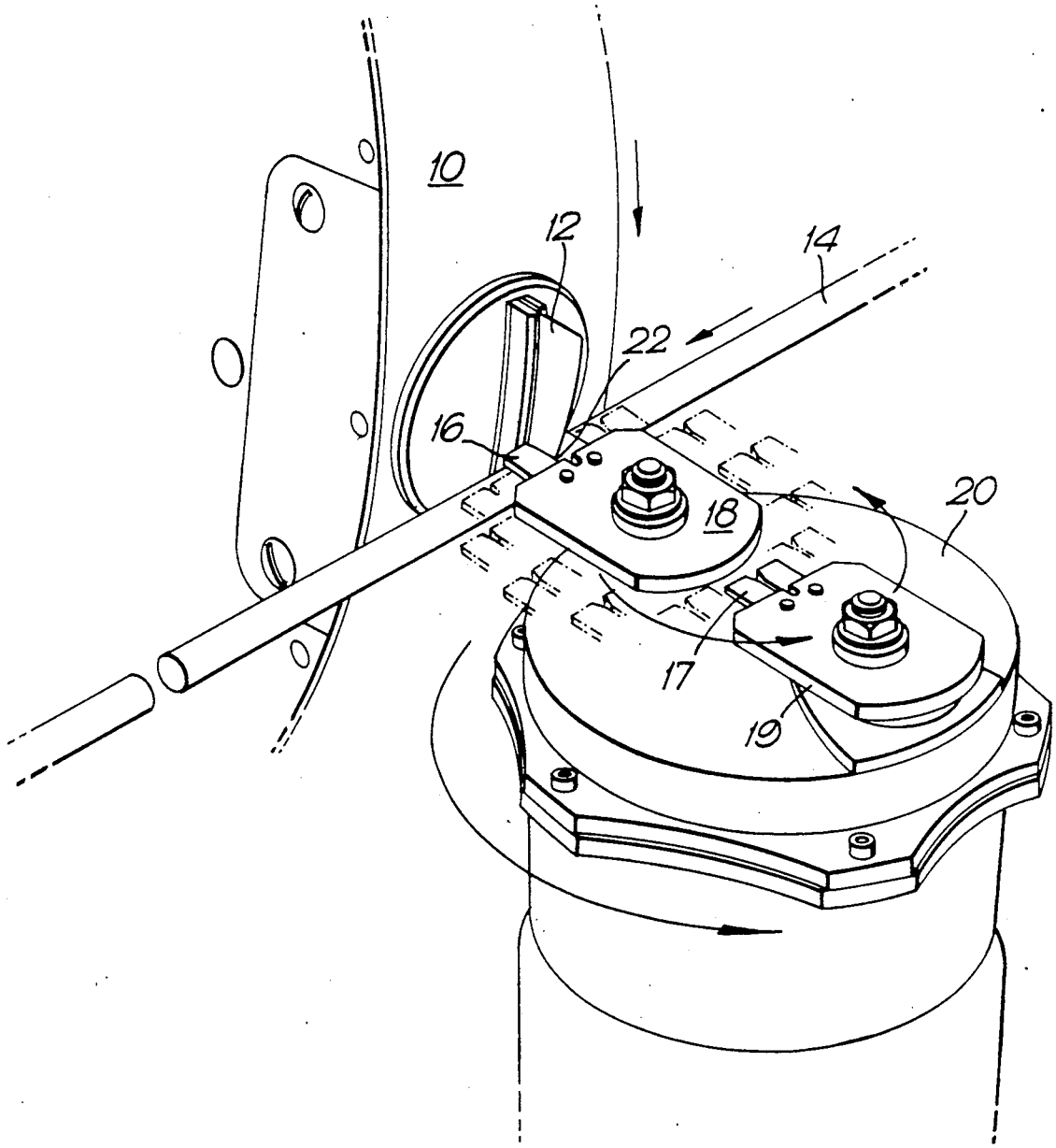

This invention relates to continuous rod-making machines, particularly for use in the production of cigarettes and cigarette filter rods.

An important factor affecting the quality of the cut ends of lengths of rods severed by a continuous rod cut-off device is the support given to the rod, and possibly also to the knife, by the ledger while the rod is being cut. It is important, therefore, that the passage of the knife and ledger are accurately synchronised. Typically, ledger assemblies, particularly rotary ledgers, are cyclically moved into their support positions by a drive arrangement including a plurality of gears.

In such an arrangement it is also important to provide adequate lubrication without allowing lubricant to contaminate the cigarette rod: this can be difficult to achieve particularly in rotary ledger arrangements including rod supports performing a planetary motion where centrifugal forces act in different directions relative to the supports according to their orbital positions.

According to one aspect of the present invention a machine for producing rod- like articles includes a continuous rod cut-off device and a ledger assembly, said assembly including means for supporting a rod during cutting, drive means for the ledger assembly, said drive means including a plurality of gears, and resilient means for applying pressure between at least one pair of interengaging gear teeth of said gears to reduce or eliminate undesired relative movement between the gears. The invention is particularly applicable to rotary ledger assemblies, that is where the support means performs a rotary cyclical movement between positions at which the rod is supported. The reduction or elimination of undesired relative movement, e.g. backlash, between gears of the drive means reduces or eliminates minor inaccuracies in synchronisation between the cut-off and the ledger assembly which may affect quality of the cut ends of lengths of rod, particularly at high rod speeds (e.g. in excess of 600 m./min.).

Preferably the resilient means comprises means for causing or tending to cause limited turning of said gears. Preferably the resilient means is arranged to apply a limited or predetermined torque to the gears without causing substantial rotation thereof. In a preferred arrangement the torque is applied between first and second gears of a gear train, the gear train possibly including one or more intermediate gears between the first and second gears. The torque may be conveniently applied through the gear train by applying a torque to a rotatable first gear while maintaining the second gear stationary.

The drive means may include at least one gear having first and second substantially coaxial gears each having teeth engaged with teeth of a further gear. Preferably the resilient means is then arranged to apply torque to at least the first of said coaxial gears. Means may be provided for applying torque to the second of said coaxial gears, substantially in opposition to torque applied by said resilient means; said means may comprise means for resisting rotation of said second coaxial gear. Said resisting means may comprise a relatively stationary gear having teeth engaged with said second coaxial gear.

The ledger assembly may include a rotatable housing carrying at least one supporting means. The drive means may include means for rotating the housing, the housing containing at least one sun gear and at least one planetary gear. The sun gear may be maintained stationary and the planetary gear may be connected to the supporting means, and an intermediate gear may be engaged with said planetary gear and said sun gear. Preferably the intermediate gear and sun gear each comprise first and second substantially coaxial portions which are rotatable relative to each other and subject to a torque tending to take up any undesired free play between interengaged gear teeth.

In a convenient arrangement wherein the plurality of gears includes a sun gear having first and second substantially coaxial portions, one of said portions is rigidly fixed and the other is rotatable relative to said one portion and subject to a predetermined torque which is applied by a torsion spring. The torsion spring may comprise a flat strip which is twisted to impose the predetermined torque by means of a rotary torque limiting device: preferably the strip extends in an axial direction relative said sun gear portions.

In a preferred arrangement, in which the ledger assembly includes a rotary housing carrying two symmetrically-disposed supporting means, the plurality of gears comprises first and second substantially coaxial sun gear portions, first and second planetary gears connected to said supporting means, and first and second intermediate gears, each of said intermediate gears comprising substantially coaxial relatively rotatable gear portions and engaged, on the one hand, with a planetary gear and, on the other hand, respectively with one of the sun gear portions. In this case one of the sun gear portions is preferably rigidly fixed, the other being rotatable relative to said one portion and, additionally, capable of translational movement while being located by the teeth of the intermediate gear portions with which it is engaged. In a sense, therefore, this other sun gear portion is "floating" relative to the other gears. Preferably the resilient means, which may be in the form of a torque-applying means such as a twisted spring steel strip, is connected to said other sun gear portion, so that the torque is applied by way of an intermediate gear portion to the planetary gear and thence through the other intermediate gear portion to the stationary sun gear portion, for each of the gear trains associated with the two supporting means.

According to another aspect of the invention a machine for producing rod-like articles includes a continuous rod cut-off device and a ledger assembly, said assembly including a rotary housing rotatable about a first axis, at least one rod support means carried by said housing and including at least one shaft extending through a wall of said housing and being rotatable relative thereto about a second axis which is spaced from said first axis, drive means within the housing, and means for supplying lubricant to said drive means, including lubricant sealing means around said shaft in the vicinity of said wall, said sealing means comprising a resilient sealing member sealingly surrounding said shaft and having a sealing surface pressed against and rotatable relative to said wall, first and second spaced annular members surrounding said shaft and defining therebetween a passage for lubricant, and collection means for collecting lubricant by action of centrifugal force in the vicinity of said shaft and for directing it from said passage for movement away from said wall and towards the interior of said housing. In a preferred construction the shaft is mounted in a bearing supported by an inner portion of said wall and said sealing member and annular rings are arranged between said inner portion and an outer portion of said wall. In this construction the bearing thus receives adequate lubrication while the lubricant sealing means ensures return of lubricant to the interior of the housing so that the risk of lubricant escape and consequent possible contamination of the rod is minimised.

According to a further aspect of the invention a machine for producing rod-like articles includes a continuous rod cut-off device and a ledger assembly, said assembly including a rotary housing rotatable about a first axis, at least one shaft extending through a wall of said housing and being rotatably supported for rotation about a second axis by a bearing in or adjacent said wall, means for lubricating said bearing including lubricant supply means in said housing and means for receiving lubricant which has passed through said bearing in a direction from the interior of said housing, said receiving means including means for sealing around said shaft, and collection means for collecting lubricant from said receiving means and for returning it to the interior of said housing, said collection means including a chamber communicating with said receiving means and said interior adjacent said bearing and arranged so as to collect lubricant by action of centrifugal force as said housing rotates.

Figure 2A:
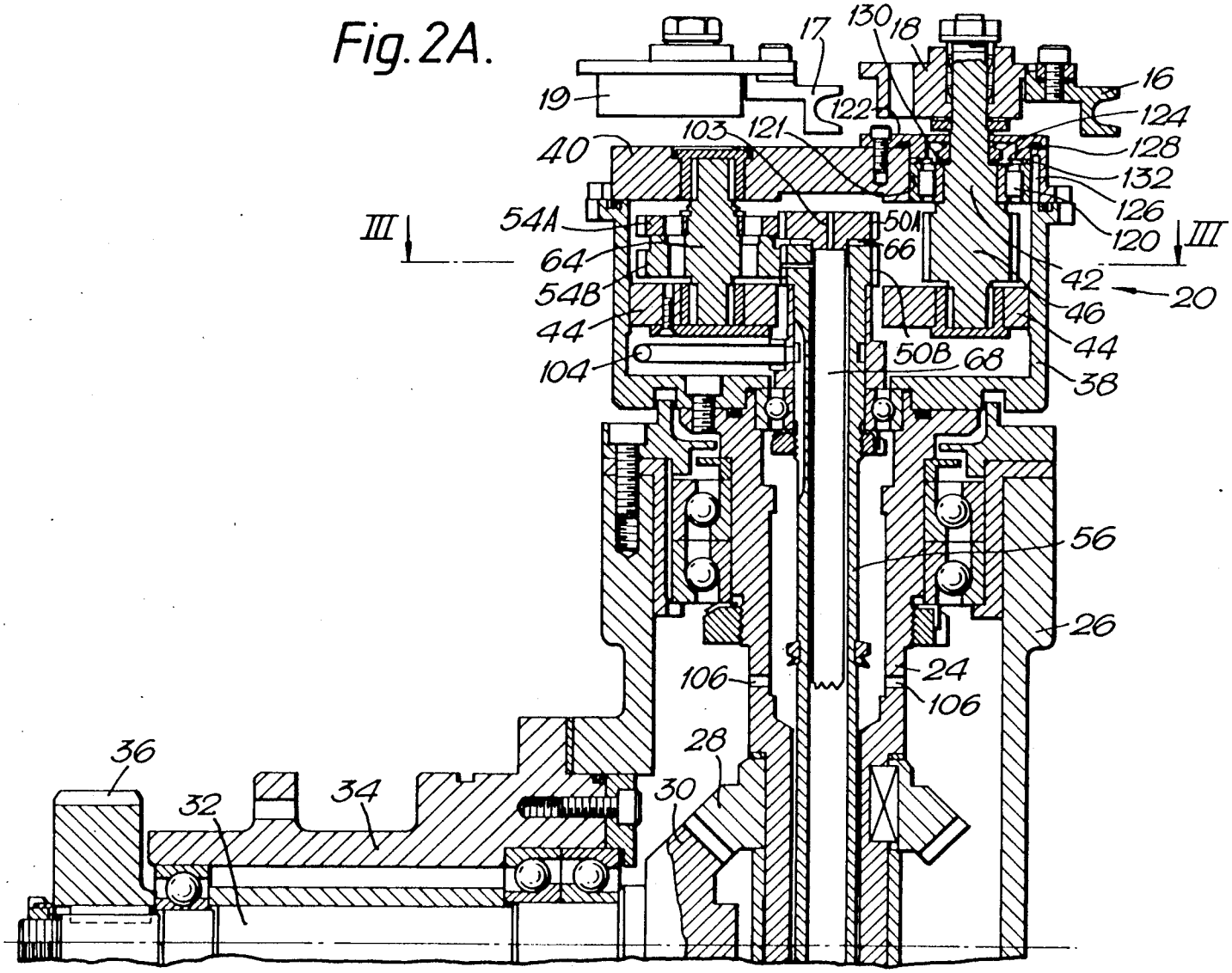
Figure 2B:
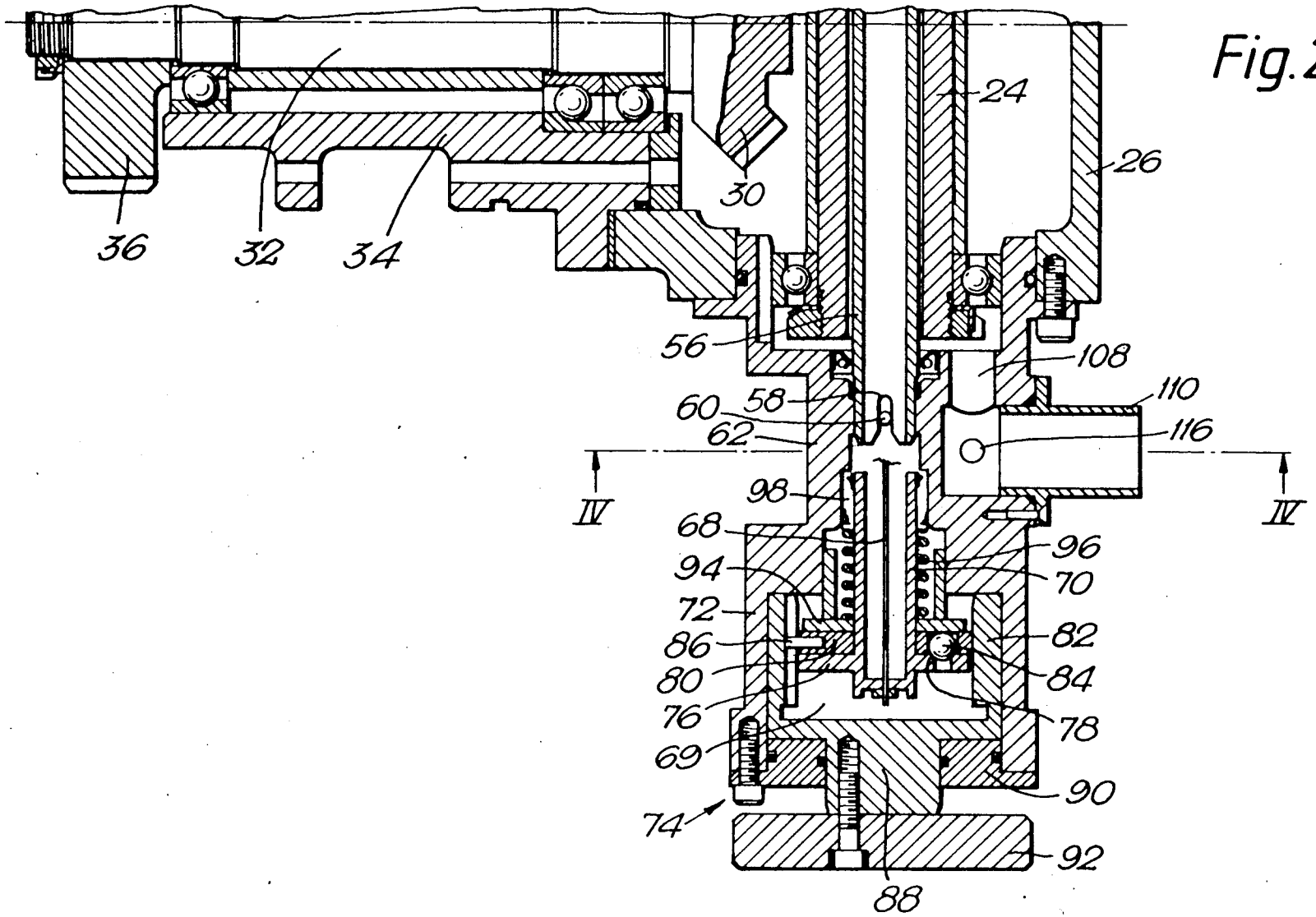
Figure 3:
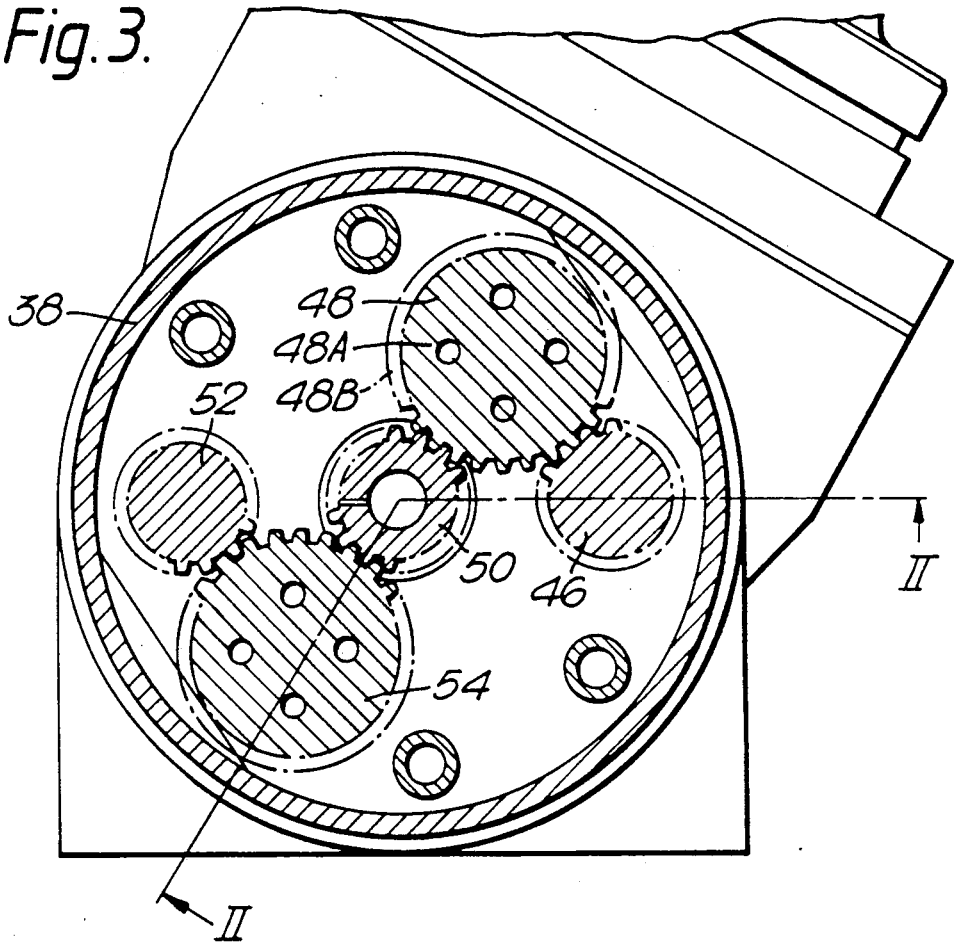
Figure 4:
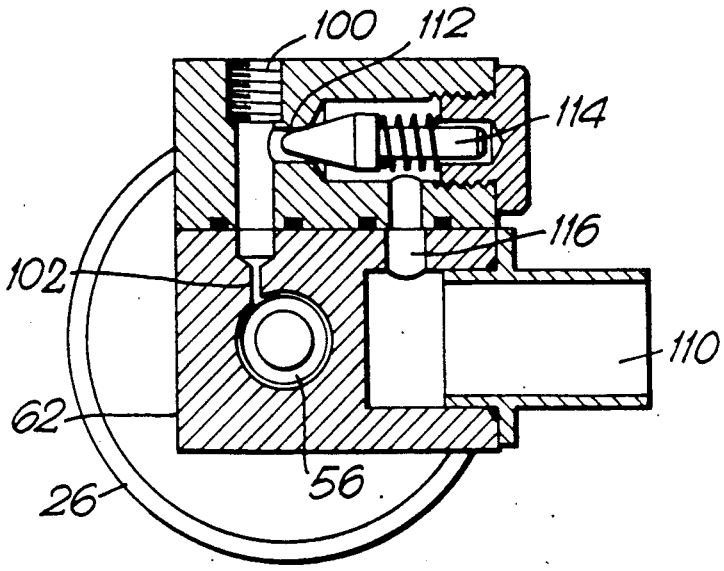

The invention will be further described, by way of example only, with reference to the accompanying diagrammatic drawings, in which:

FIG. 1 is a perspective view of a cut-off and ledger assembly for a continuous rod-making machine, FIGS. 2A and 2B are respectively longitudinal sectional views of upper and lower portions of the ledger assembly of FIG. 1, on the line II—II in FIG. 3, FIG. 3 is a transverse sectional view on the line III—III in FIG. 2A, and FIG. 4 is a transverse sectional view on the line IV—IV in FIG. 2B.

FIG. 1 shows part of a continuous rod-making machine including a rotary cut-off 10 having a knife 12 for severing a continuous rod 14. A U-shaped support ledger 16 supports the rod 14 during passage of the knife 12 through the rod 14. The ledger 16 is carried by a first ledger station 18 which in turn is carried by a rotary ledger head 20. The ledger head 20 has a second ledger 17 and corresponding station 19. The rotation of the ledger head 20 is synchronised with rotation of the rotary cut-off 10 so that passage of the knife 12 through the rod 14 coincides with location of the ledger 16 around the rod, the knife passing through a groove 22 in the ledger. The cut-off 10 carries a second knife (not shown) which co-operates with the ledger 17. During rotation of the ledger head 20 the ledger stations 18, 19 rotate relative to the head so that the ledgers 16, 17 remain parallel to themselves, i.e. always pointing towards the rod 14.

FIGS. 2A and 2B together show the drive arrangement for the ledger assembly. The ledger head 20 is connected to a vertical tubular drive shaft 24 which is rotatably supported in a vertical cylindrical casing 26. The drive shaft 24 carries a bevel gear 28 which is engaged, within the casing 26, with a further bevel gear 30 connected at the end of a horizontal drive shaft 32. The drive shaft 32 is rotatably supported in a stub casing 34 connected to the casing 26 and carries at its outer end a spur gear 36 which is engaged with a gear (not shown) driven synchronously with the drive for the rotary cut-off 10.

The ledger head 20 comprises a generally cup-shaped housing 38 with a lid portion 40 connected to it. The ledger station 18 is carried on a stub shaft 42 which is rotatably supported in the lid portion 40 and, at its lower end, by an internal flange 44 in the housing 38. The portion of the shaft 42 between the lid portion 40 and the flange 44 is integrally formed as a gear 46.

As best shown in FIG. 3, the gear 46 is a planetary gear which is engaged via an intermediate gear 48 with a central sun gear 50. A gear 52, which is of substantially similar construction to the gear 46, is similarly connected to the other ledger station 19 and is engaged with a further intermediate gear 54 which is in turn engaged with the sun gear 50. The gears 46, 48 and 52, 54 are symmetrically arranged around the sun gear 50.

Referring now to FIGS. 2A and 2B, the sun gear 50 is formed in upper and lower portions 50A, 50B respectively. The lower portion 50B is integral with a cylindrical tube 56 which extends coaxially downwards through the drive shaft 24. At its lower end the tube 56 is formed with a slot 58 into which extends a pin 60 which is rigidly connected to a lower housing 62 bolted to the lower end of the casing 26.

The intermediate gear 54 is also formed in upper and lower portions 54A, 54B, which are respectively engaged with the upper and lower portions 50A, 50B of the sun gear 50. The lower portion 54B is carried by a vertical stub shaft 64 rotatably supported between the flange 44 and the lid portion 40. The upper gear portion 54A is coaxially supported by shaft 64 so that it is rotatable relative to the lower gear portion 54B. Both upper and lower intermediate gear portions 54A, 54B are engaged with the single gear 52 for the ledger station 19. The intermediate gear 48 (FIG. 3) is of identical construction to the gear 54, having upper and lower portions (48A, 48B, respectively), and being engaged respectively with the upper and lower sun gear portions 50A, 50B and the single gear 46 for the ledger station 18.

The upper sun gear portion 50A is supported above the lower portion 50B on a thrust roller bearing 66 so that it is able to rotate relative to the portion 50B. The axis of the upper gear portion 50A is not fixed, so that it may move radially (while remaining in engagement with the intermediate gear portions 48A and 54A).

The lower face of the upper sun gear portion 50A is formed with a diametral slot which accommodates one end of a flat strip 68 of steel. The strip 68 extends downwards through the hollow drive shaft 56 and at its lower end is held in a slot 69 at the end of a tubular member 70. Note that for clarity the strip 68 is shown angularly displaced through 90 degrees at its lower end (68A) as compared with its upper end: in practice the amount of twist will normally be less than that.

The tubular member 70 forms part of a device 74 which is mounted within an extension 72 of the housing 62 and is arranged to apply a predetermined torque to the upper sun gear portion 50A via the strip 68. At its lower end the tubular member 70 carries an external annular flange 76 having three angularly-spaced recesses 78 (only one of which is shown in FIG. 4). Immediately above the flange 76 is an annular cage 80 carrying three balls 84 each of which is normally seated in one of the recesses 78. The cage 80 is connected for rotation with a sleeve member 82 by angularly-spaced pins 86 (only one of which is shown in FIG. 2B). The sleeve member 82 is rotatably supported within the housing extension 72 and has an integral cylindrical portion 88 which extends downwards through an end plate 90 of the housing extension. A turn knob 92 is connected to the cylindrical portion 88.

The ball cage 80 is urged into contact with the flange 76 by a pusher plate 94 which is acted upon by a compression spring 96 surrounding part of the tubular member 70. A roller clutch 98 is arranged between an upper portion of the tubular member 70 and an internal bore in the housing 62.

In operation, the drive shaft 32 is driven synchronously with the cut-off head 10 and this in turn causes rotation of the ledger head 20 by way of bevel gears 30, 28 and drive shaft 24. During rotation of the ledger head 20 the lower sun gear portion 50B remains stationary by virtue of the pin 60 holding the integral tube 56 stationary. The gears 46, 48, 52, 54 rotate bodily around the sun gear 50 and, since gears 46, 50 and 52 have similar numbers of teeth, the ledger stations 18, 19 retain the same orientation in space as the ledger head 20 rotates.

It will be appreciated that it is important that the support ledgers 16, 17 are accurately positioned at the instant the knives 12 sever the rod 14. In order to achieve sufficient accuracy, particularly at high speed, it is desirable to minimise or eliminate any backlash in the gears 46–54, which could affect this accuracy. Reduction or elimination of backlash is achieved by applying a predetermined torque to the upper sun gear portion 50A by way of the steel strip 68. The effect of this torque is to load the gear teeth of gear portion 50A against the respective teeth of upper intermediate gear portions 48A, 54A. Since the upper intermediate gear portions 48A, 54A are free to rotate, the torque transmitted to them is transferred to the respective gears 46 and 52. Similarly the gears 46 and 52 are free to rotate and in turn transmit the torque to the lower intermediate gears 48B, 54B. The lower intermediate gear portions 48B, 54B are free to rotate relative to the upper intermediate gear portions 48A, 54A but are engaged with the stationary lower sun gear portion 50B. The effect of applying torque to the upper sun gear portion 50A is, therefore, that the gear trains 50A, 48A, 46, 48B, 50B and 50A, 54A, 52, 54B, 50B are each independently loaded so that the respective engaging gear teeth are pressed against each other, eliminating backlash by the applied torque acting against the reaction of the stationary lower sun gear portion 50B. Note that the upper and lower intermediate gear portions 48A, 48B and 54A, 54B press on opposite sides of the gear teeth of gears 46 and 52 respectively. The torque is preferably applied by the upper sun gear portion 50A in such a direction that it tends to reinforce the pressure applied on stationary lower sun gear portion 50B during rotation. Thus, where the ledger head 20 rotates in an anticlockwise direction as viewed in FIG. 3 the torque is preferably applied through the upper sun gear portion 50A so that it tends to rotate the gear portion 50A also in an anticlockwise direction as viewed in FIG. 3.

The axis of upper sun gear portion 50A is not fixed, i.e. it is capable of radial movement; in this way the gear portion 50A is capable of small translational movements, as dictated by minor inaccuracies in the forming of its gear teeth or those of the gears with which it is engaged, so as to take up a position as dictated by the reactionary forces transmitted through the upper intermediate gear portions 48A, 54A. Thus the upper sun gear portion 50A may perform small cyclical translational movements during rotation of the ledger head 20.

The device 74 applies the necessary predetermined torque to the steel strip 68 for transmission to the upper sun gear portion 50A. Rotation of the turn knob 92 causes corresponding rotation of the sleeve 82 and cage 80. As the cage 80 starts to rotate relative to the flange 76 it causes each of the balls 84 to rise out of the recesses 78 against the resistance of the compression spring 96. As the balls 84 rise up the inclined faces of the recesses 74 the resistance of the compression spring 96 acting against the pressure plate 94 is converted into a turning force on the tubular member 70 by reaction of the balls 84 against the inclined faces. Further movement of the turn knob 92 eventually causes the balls 84 to ride completely out of their recesses 78 thereby displacing the pressure plate 94 until the balls fall back into the next recesses 78 on further rotation of the turn knob 92. Torque is transmitted to the tubular member 70 only while the balls 84 are asymmetrically in contact with the inclined faces of the recesses 78.

The roller clutch 98 is arranged to allow rotation of the tubular portion 70 only in the direction in which it is required to apply torque to the upper sun gear portion 50A. Thus, in the present arrangement where it is preferred to apply torque to the gear portion 50A in an anticlockwise direction as viewed in FIG. 5 the roller clutch 98 allows rotation only in a direction corresponding to clockwise rotation of the turn knob 92 (as viewed from its outer, i.e. lower, end). Whenever the turn knob 92 is rotated in this direction by an amount sufficient to cause the balls 84 to rise out of the recesses 78 a predetermined torque is applied to the strip 68, corresponding to the maximum component derived from compression of the spring 96 acting on the inclined faces of the recesses 78. Further rotation of the turn knob 92 will periodically apply the same torque to the strip 68 but will not cause any further twisting of the strip 68 once the backlash in the gears 46–54 has been taken up and the strip 68 assumes a twisted condition corresponding to application of the predetermined torque. The roller clutch 98 retains the tubular member 70 in its rotationally displaced position and prevents any rotation in the reverse direction, thereby ensuring that the strip 68 retains the torque applied to it. Typically when the backlash has been taken up in the gears 46, 54 the applied torque causes a twist of about 50 degrees along the length of the strip 68. After the predetermined torque has been applied to the gears 46–54 within the ledger head 20 to take up the backlash between the teeth, occasional further turning of the turn knob 92 may be required to ensure that the torque remains applied and to take up any relative movement of the gears, due for example to wear of the teeth.

Referring also to FIG. 4 the drive arrangement includes a pressurised oil lubrication system including an oil inlet 100 which delivers oil under pressure through a small bore 102 into the inner bore of the housing 62 from which it passes upwards to the tube 56 and through a bore 103 (FIG. 2) in upper sun gear portion 50A into the ledger head 20 for lubrication of the gears 46–54. Return oil flow is by way of a collector tube 104 (FIG. 2) which remains stationary within the ledger head 20 and collects oil by action of centrifugal force. The action of the collector tube 104 is substantially similar to that disclosed in our British Patent Specification No. 2196230, to which reference is directed for further details. Oil colected by the tube 104 drains into the annular region between tube 56 and drive shaft 24 and thence, via outlets 106 (FIG. 2), into the region of the bevel gears 28, 30. Finally, return oil passes through a drain channel 108 (FIG. 2) to an outlet 110. As shown in FIG. 4, a pressure relief valve 112 is arranged between passages 114, 116 connecting the inlet 100 and outlet 110.

It will be appreciated that it is particularly important that oil does not escape from the region of the ledger head 20, where it could contaminate the passing cigarette rod 14. In this respect the most critical area is where the stub shaft 42 projects through the lid portion 40. In order to provide adequate lubrication for the upper bearing 120 of the shaft 42, which is contained in an aparture 121 in lid portion 40, it is necessary to provide for through flow of oil to the region above the bearing: this region is sealed by a cap 122 having an aperture through which the shaft 42 projects. A rubber V-ring seal 124 surrounds the shaft 42 and has a sealing surface which bears lightly against the inner face of the cap 122. The seal is compressed slightly between this inner face and a shoulder of the shaft 42, thereby pressing the sealing surface lightly against the inner face to prevent oil escape. Excess oil passing through the bearing 120 is collected in a gallery 126 which extends partly around the circumference of the aperture 121 adjacent the edge of the lid portion, so that centrifugal force during rotation of the housing 38 causes migration of oil towards the gallery, which provides an oil path back through the bearing to the inner chamber of the housing 38. Note that immediately above the bearing 120 are concentric annular members 128, 130 respectively bearing against an inner shoulder of the cap 122 and an upper shoulder of a housing member for the bearing 120, the members being separated by a wavy washer 132 which keeps them spaced in an axial direction and provides a flow path between them so that oil passing through the bearing 120 has a path to the gallery 126.

I claim:

1. A machine for producing rod-like articles comprising a continuous rod cut-off device and a ledger assembly, said assembly including means for supporting a rod during cutting, drive means for the ledger assembly, said drive means including a plurality of gears, and resilient means for applying pressure between at least one pair of interengaging gear teeth of said gears to reduce or eliminate undesired relative movement between the gears, wherein said gears include a least one gear having first and second substantially coaxial gears each having teeth engaged with teeth of a common further gear, and wherein said resilient means is arranged to apply torque to at least the first of said coaxial gears.

2. A machine as claimed in claim 1, wherein the resilient means comprises means for causing limited turning of said gears.

3. A machine as claimed in claim 2, wherein the resilients means comprises means for applying a predetermined torque to said gears without causing substantial rotation thereof.

4. A machine as claimed in claim 1, wherein said gears further include third and fourth substantially coaxial gears in engagement with said first and second coaxial gears, respectively, said torque applying means comprising means for applying torque to the third coaxial gear while maintaining the fourth coaxial gear stationary.

5. A machine as claimed in claim 1, further including means for applying torque to the second of said coaxial gears, substantially in opposition to torque applied by said resilient means.

6. A machine as claimed in claim 5, wherein the means for applying torque to the second of said coaxial gears comprises a stationary gear having teeth engaged with said second coaxial gear.

7. A machine as claimed in claim 1, wherein the ledger assembly comprises a rotatable housing carrying at least one supporting means, said drive means including means for rotating the housing, and said housing comprising at least one sun gear and at least one planetary gear.

8. A machine for producing rod-like articles comprising a continuous rod cut-off device and a ledger assembly, said assembly including means for supporting a rod during cutting, drive means for the ledger assembly, said drive means including a plurality of gears, and resilient means for applying pressure between at least one pair of interengaging gear teeth of said gears to reduce or eliminate undesired relative movement between the gears, the ledger assembly comprising a rotatable housing carrying at least one supporting means, said drive means including means for rotating the housing, and said housing comprising at least one sun gear and at least one planetary gear, further including means for maintaining the sun gear stationary, and an intermediate gear engaged with said sun gear and said planetary gear, wherein the intermediate and sun gears each comprise first and second substantially coaxial portions which are rotatable relative to each other, and wherein said resilient means is arranged to exert a torque tending to take up undesired free play between interengaged gear teeth of said gears by urging said coaxial portions in opposite rotational directions.

9. A machine for producing rod-like articles comprising a continuous rod cut-off device and a ledger assembly, said assembly including means for supporting a rod during cutting, drive means for the ledger assembly, said drive means including a plurality of gears, and resilient means for applying pressure between at least one pair of interengaging gear teeth of said gears to reduce or eliminate undesired relative movement between the gears, the ledger assembly comprising a rotatable housing carrying at least one supporting means, said drive means including means for rotating the housing, and said housing comprising at least one sun gear and at least one planetary gear, wherein said sun gear has first and second substantially coaxial portions, one of said portions being rigidly fixed and the other being rotatable relative to said one portion and subject to a predetermined torque applied by said resilient means.

10. A machine as claimed in claim 9, wherein said resilient means comprises a torsion spring and a rotary torque limiting device for applying a predetermined torque to the torsion spring.

11. A machine as claimed in claim 9, wherein said resilient means comprises a torsion spring in the form of a flat strip twistable about its longitudinal axis to apply torque to said other sun gear portion.

12. A machine as claimed in claim 11, wherein the flat strip is directly connected to said other sun gear portion and extends in an axial direction relative to said portion.

13. A machine for producing rod-like articles comprising a continuous rod cut-off device and a ledger assembly, said assembly including means for supporting a rod during cutting, drive means for the ledger assembly, said drive means including a plurality of gears, and resilient means for applying pressure between at least one pair of interengaging gear teeth of said gears to reduce or eliminate undesired relative movement between the gears, the ledger assembly comprising a rotatable housing carrying at least one supporting means, said drive means including means for rotating the housing, and said housing comprising at least one sun gear and at least one planetary gear, including two symmetrically-disposed supporting means, first and second substantially coaxial sun gear portions, first and second planetary gears connected to said supporting means, and first and second intermediate gears, each of said intermediate gears comprising substantially coaxial relatively rotatable gear portions and engaged, on the one hand, with a planetary gear and, on the other hand, respectively with one of the sun gear portions.

14. A machine as claimed in claim 13, wherein one of the sun gear portions is relatively fixed and the other of said portions is rotatable relative to said one portion and, additionally, capable of translational movement while being located by the teeth of the intermediate gear portions with which it is engaged.

15. A machine as claimed in claim 14, wherein the resilient means comprises torque-applying means connected to said other sun gear portion, so that, for each of the gear trains associated with the two supporting means, the torque is applied by way of an intermediate gear portion to the respective planetary gear and thence through the other intermediate gear portion to the stationary sun gear portion.

16. A machine for producing rod-like articles, comprising a continuous rod cut-off device and a ledger assembly, said assembly including a rotary housing rotatable about a first axis, at least one shaft extending through a wall of said housing and being rotatably supported for rotation about a second axis by a bearing in or adjacent said wall, means for lubricating said bearing including lubricant supply means in said housing and means for receiving lubricant which has passed through said bearing in a direction from the interior of said housing, said receiving means including means for sealing round said shaft, and collection means for collecting lubricant from said receiving means and for returning it to the interior of said housing, said collection means including a chamber communicating with said receiving means and said interior adjacent said bearing and arranged so as to collect lubricant by action or centrifugal force as said housing rotates.

17. A machine for producing rod-like articles, comprising a continuous rod cut-off device and a ledger assembly, said assembly including a rotary housing rotatable about a first axis, at least one rod support means carried by said housing and including at least one shaft extending through a wall of said housing and being rotatable relative thereto about a second axis which is spaced from said first axis, drive means within the housing, and means for supplying lubricant to said drive means, including lubricant sealing means around said shaft in the vicinity of said wall, said sealing means comprising a resilient sealing member sealingly surrounding said shaft and having a sealing surface pressed against and rotatable relative to said wall, first and second spaced annular members surrounding said shaft and defining therebetween a passage for lubricant, and collection means for collecting lubricant by action of centrifugal force in the vicinity of said shaft and for directing it from said passage for movement away from said wall and towards the interior of said housing.

18. A machine as claimed in claim 17, wherein said wall includes an inner portion supporting a bearing for said shaft, and an outer portion, said sealing member and said annular rings being arranged between said inner and outer portions.

19. A machine as claimed in claim 18, wherein said collection means includes means extending through said inner portion of said wall.

20. A machine for producing rod-like articles comprising a continuous rod cut-off device and a ledger assembly, said assembly including means for supporting a rod during cutting, drive means for the ledger assembly, said drive means including a plurality of gears, and resilient means for applying pressure between at least one pair of interengaging gear teeth of said gears to reduce or eliminate undesired relative movement between the gears, wherein at least one of said gears has first and second substantially coaxial gear portions, said portions being relatively rotatable and subject to a predetermined torque applied by said resilient means for causing limited relative rotation of said gear portions, and wherein each of said coaxial gear portions is engaged with a common further gear of said drive means.

21. A machine for producing rod-like articles comprising a continuous rod cut-off device and a ledger assembly, said assembly including means for supporting a rod during cutting, drive means for the ledger assembly, said drive means including a plurality of gears, and resilient means for applying pressure between at least one pair of interengaging gear teeth of said gears to reduce or eliminate undesired relative movement between the gears, wherein at least one of said gear has first and second substantially coaxial gear portions, said portions being relatively rotatable and subject to a predetermined torque applied by said resilient means for causing limited relative rotation of said gear portions, and wherein said resilient means comprises a torsion spring in the form of a flat strip twistable about its longitudinal axis, said axis being substantially coaxial with said gear portions.

22. A machine as claimed in claim 21, wherein said drive means includes a tubular drive shaft, said flat strip extending through said shaft.

23. A machine as claimed as claim 22, further including adjustment means for twisting said strip to apply a predetermined torque, said adjustments means being arranged to operate adjacent one end of said strip which extends beyond one end of said drive shaft, the other end of said strip being connected to one of said gear portions beyond the other end of said drive shaft.

* * * * *